US006394438B1

(12) United States Patent
Glaser

(10) Patent No.: US 6,394,438 B1
(45) Date of Patent: May 28, 2002

(54) MULTILEVEL CLAMP DEVICE

(76) Inventor: Richard D. Glaser, 2661 Highway QQ, Green Bay, WI (US) 54311

( * ) Notice: Subject to any disclaimer, the term of this patent is extended or adjusted under 35 U.S.C. 154(b) by 0 days.

(21) Appl. No.: 09/853,490

(22) Filed: May 11, 2001

(51) Int. Cl.[7] ..... B25B 1/20
(52) U.S. Cl. ..... 269/43; 269/45; 269/282
(58) Field of Search ..... 269/43, 905, 243, 269/53, 47, 246, 51, 111, 172, 189, 282, 283, 45

(56) References Cited

U.S. PATENT DOCUMENTS

| | | | | |
|---|---|---|---|---|
| 912,543 | A | 2/1909 | Cobb | |
| 1,432,597 | A | 10/1922 | Geczynski | |
| 2,274,428 | A | 2/1942 | Odin | |
| D151,429 | S | 10/1948 | Clauss | |
| 2,662,433 | A * | 12/1953 | Braun | 269/43 |
| 3,861,664 | A * | 1/1975 | Durkee | 269/43 |
| 4,341,375 | A * | 7/1982 | Romanin | 259/43 |
| 4,948,108 | A * | 8/1990 | Sullivan | 269/903 |
| 5,623,757 | A | 4/1997 | Durfee, Jr. | |
| 5,816,568 | A * | 10/1998 | Fox | 269/60 |
| 5,893,551 | A | 4/1999 | Cousins et al. | |

* cited by examiner

*Primary Examiner*—Joseph J. Hail, III
*Assistant Examiner*—Lee Wilson

(57) ABSTRACT

A mutlilevel clamp device for holding a plurality of frames during gluing procedures. The mutlilevel clamp device includes a plurality of clamps. Each of the clamps comprises a first end wall and a second end wall. A bar extends between and is attached to the end walls. The bar has a channel therein extending between the end walls. A rod is positioned in the channel and extends between the end walls. The rod is rotatably coupled to the end walls and has a free end extending through the first end wall. The rod is threaded. A block is positioned in the channel and extends upwardly out of the channel. The rod extends through the block and threadably engages the block. The block is moved along the channel by rotation of the rod.

8 Claims, 4 Drawing Sheets

MULTILEVEL CLAMP DEVICE

BACKGROUND OF THE INVENTION

1. Field of the Invention

The present invention relates to clamp devices and more particularly pertains to a new mutlilevel clamp device for holding a plurality of frames during gluing procedures.

2. Description of the Prior Art

The use of clamp devices is known in the prior art. More specifically, clamp devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,623,757; 5,893,551; 2,274,428; 1,432,597; 912,543; and U.S. Des. Pat. No. 151,429.

While these devices fulfill their respective, particular objectives and requirements, the aforementioned patents do not disclose a new mutlilevel clamp device. The inventive device includes a plurality of clamps. Each of the clamps comprises a first end wall and a second end wall. A bar extends between and is attached to the end walls. The bar has a channel therein extending between the end walls. A rod is positioned in the channel and extends between the end walls. The rod is rotatably coupled to the end walls and has a free end extending through the first end wall. The rod is threaded. A block is positioned in the channel and extends upwardly out of the channel. The rod extends through the block and threadably engages the block. The block is moved along the channel by rotation of the rod.

In these respects, the mutlilevel clamp device according to the present invention substantially departs from the conventional concepts and designs of the prior art, and in so doing provides an apparatus primarily developed for the purpose of holding a plurality of frames during gluing procedures.

SUMMARY OF THE INVENTION

In view of the foregoing disadvantages inherent in the known types of clamp devices now present in the prior art, the present invention provides a new mutlilevel clamp device construction wherein the same can be utilized for holding a plurality of frames during gluing procedures.

The general purpose of the present invention, which will be described subsequently in greater detail, is to provide a new mutlilevel clamp device apparatus and method which has many of the advantages of the clamp devices mentioned heretofore and many novel features that result in a new mutlilevel clamp device which is not anticipated, rendered obvious, suggested, or even implied by any of the prior art clamp devices, either alone or in any combination thereof.

To attain this, the present invention generally comprises a plurality of clamps. Each of the clamps comprises a first end wall and a second end wall. A bar extends between and is attached to the end walls. The bar has a channel therein extending between the end walls. A rod is positioned in the channel and extends between the end walls. The rod is rotatably coupled to the end walls and has a free end extending through the first end wall. The rod is threaded. A block is positioned in the channel and extends upwardly out of the channel. The rod extends through the block and threadably engages the block. The block is moved along the channel by rotation of the rod.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mutlilevel clamp device apparatus and method which has many of the advantages of the clamp devices mentioned heretofore and many novel features that result in a new mutlilevel clamp device which is not anticipated, rendered obvious, suggested, or even implied by any of the prior art clamp devices, either alone or in any combination thereof.

It is another object of the present invention to provide a new mutlilevel clamp device which may be easily and efficiently manufactured and marketed.

It is a further object of the present invention to provide a new mutlilevel clamp device which is of a durable and reliable construction.

An even further object of the present invention is to provide a new mutlilevel clamp device which is susceptible of a low cost of manufacture with regard to both materials and labor, and which accordingly is then susceptible of low prices of sale to the consuming public, thereby making such mutlilevel clamp device economically available to the buying public.

Still yet another object of the present invention is to provide a new mutlilevel clamp device which provides in the apparatuses and methods of the prior art some of the advantages thereof, while simultaneously overcoming some of the disadvantages normally associated therewith.

Still another object of the present invention is to provide a new mutlilevel clamp device for holding a plurality of frames during gluing procedures.

Yet another object of the present invention is to provide a new mutlilevel clamp device which includes a plurality of clamps. Each of the clamps comprises a first end wall and a second end wall. A bar extends between and is attached to the end walls. The bar has a channel therein extending between the end walls. A rod is positioned in the channel and extends between the end walls. The rod is rotatably coupled to the end walls and has a free end extending through the first end wall. The rod is threaded. A block is positioned in the channel and extends upwardly out of the channel. The rod extends through the block and threadably engages the block. The block is moved along the channel by rotation of the rod.

Still yet another object of the present invention is to provide a new mutlilevel clamp device that allows a multitude of frames and doors for gluing and other woodworking procedures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there.are illustrated preferred embodiments of the invention.

BRIEF DESCRIPTION OF THE DRAWINGS

The invention will be better understood and objects other than those set forth above will become apparent when consideration is given to the.following detailed description thereof. Such description makes reference to the annexed drawings wherein.

DESCRIPTION OF THE PREFERRED EMBODIMENT

Figure 1:
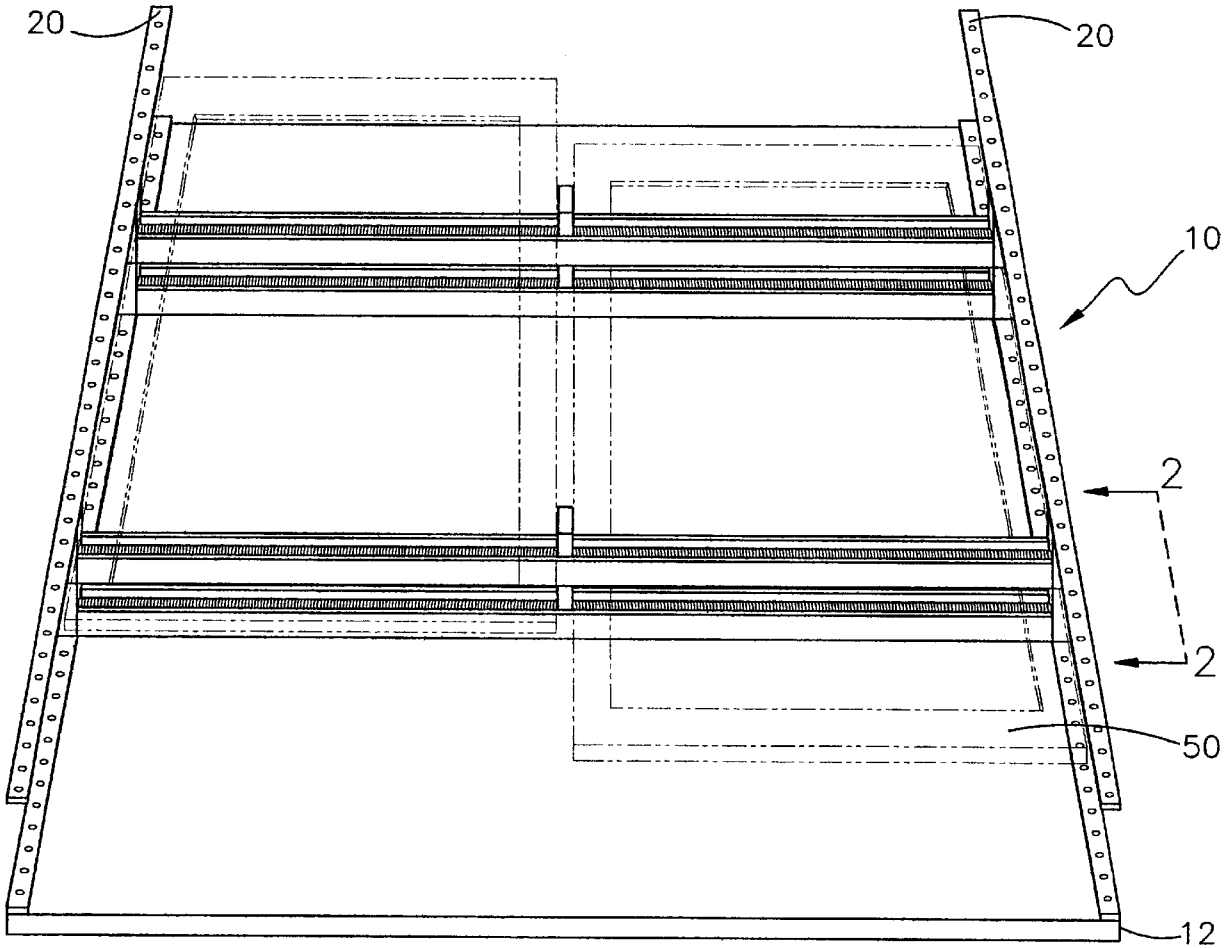
FIG. 1 is a schematic perspective view of a new mutlilevel clamp device according to the present invention.
Figure 2:
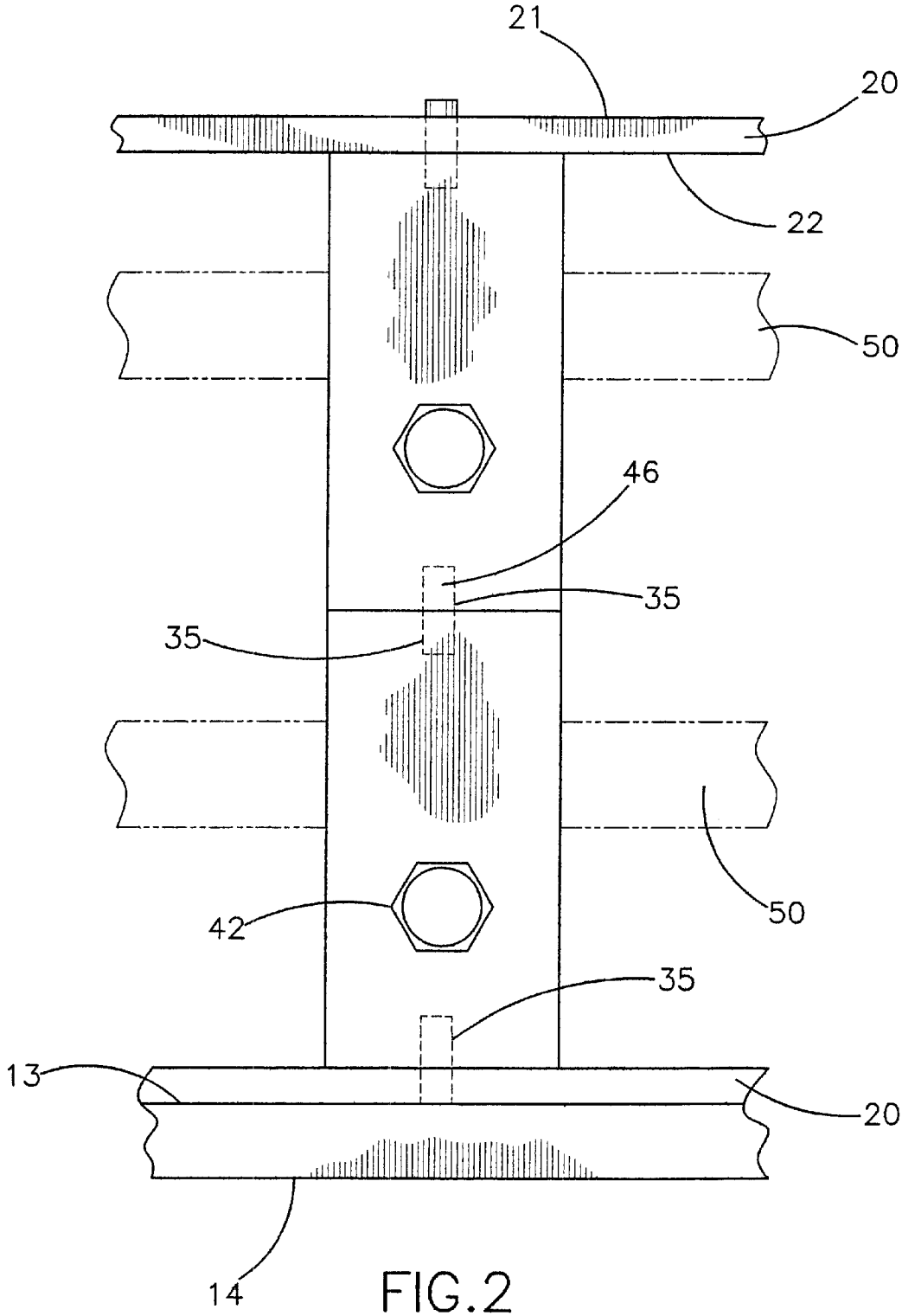
FIG. 2 is a schematic side view taken along line 2—2 of FIG. 1 of the present invention.
Figures 3, 4:
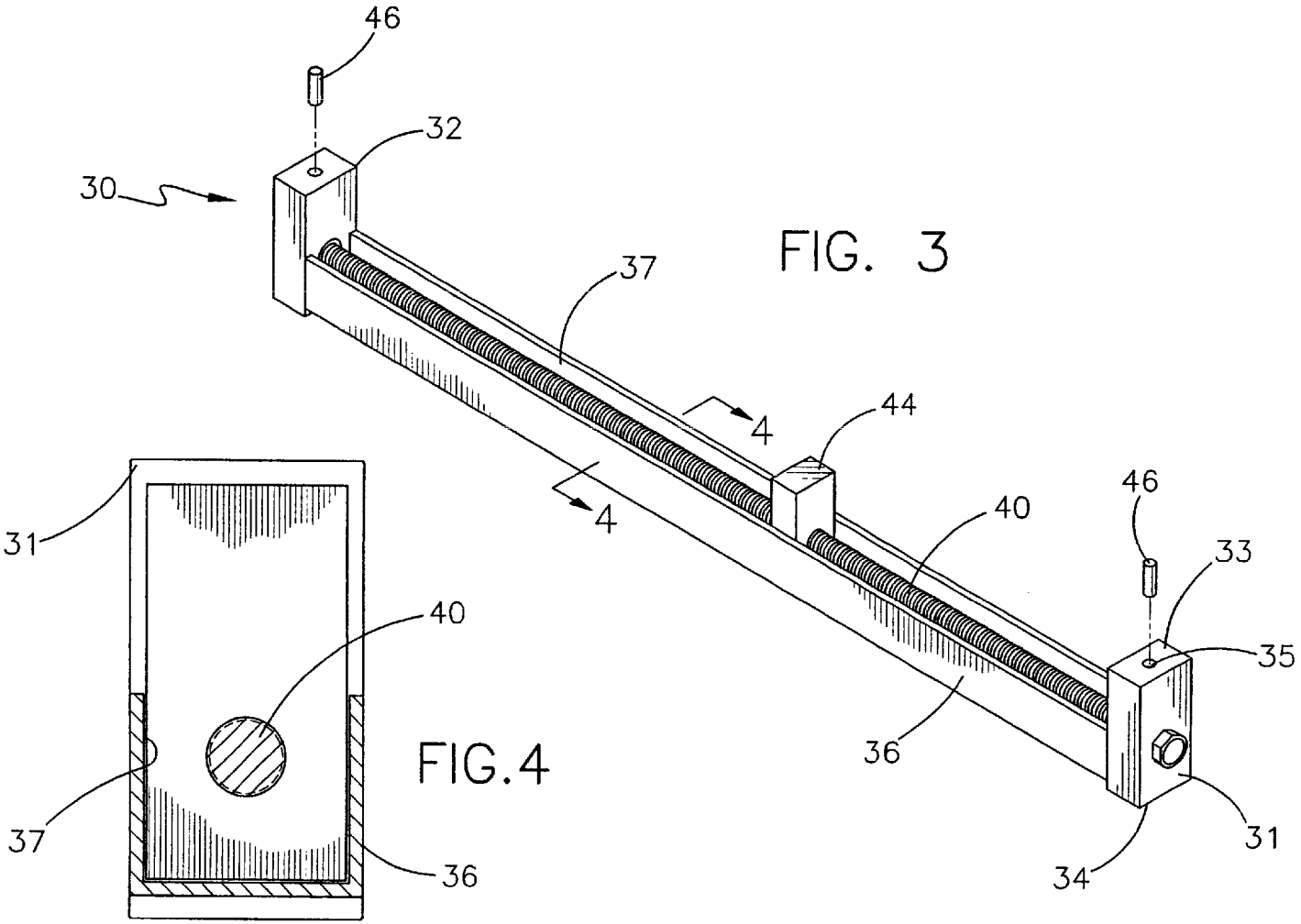
FIG. 3 is a schematic perspective view of a clamp of the present invention.
FIG. 4 is a schematic cross-sectional view taken along line 4—4 of the present invention.

With reference now to the drawings, and in particular to FIGS. 1 through 5 thereof, a new mutlilevel clamp device embodying the principles and concepts of the present invention and generally designated by the reference numeral 10 will be described.

As best illustrated in FIGS. 1 through 5, the mutlilevel clamp device 10 generally comprises a panel 12 having a top surface 13, a bottom surface 14, a first edge 15, a second edge 16, a third edge 17, and a fourth edge 18. The first 15 and second 16 edges are located opposite of each other. The panel 12 has a generally rectangular shape.

Each of a plurality of mountings 20 is elongated and has a top side 21 and a bottom side 22. Each of the mountings 20 has a plurality of aligned apertures 23 therein extending through the top 21 and bottom 22 sides. The bottom side 22 of a first of the mountings 24 is attached to the top surface 13 of the panel 12 and extends along the first edge 15. The bottom side 22 of a second of the mountings 25 is attached to the top surface 13 of the panel 12 and extending along the second edge 16.

Each of a plurality of clamps 30 includes a first end wall 31 and a second end wall 32. Each of the end walls 31, 32 has a upper surface 33 and a lower surface 34 having a hole 35 extending therein. A bar 36 extends between and is attached to the end walls 31, 32. The bar 36 has a length such each of the end walls 31, 32 may be positioned over one of the first 24 and second 25 mountings when the bar 36 is orientated perpendicular to the first 24 and second 25 mountings. The bar 36 has a channel 37 therein extending between the end walls 31, 32.

A rod 40 is positioned in the channel 37 and extends between the end walls 31, 32. The rod 40 is rotatably coupled to the end walls. The rod 40 has a free end extending through the first end wall 32 having a bolt type head 42 thereon. The rod 40 is threaded.

A block 44 is positioned in the channel 37 and extends upwardly out of the channel 37. The rod 40 extends through the block 44 and threadably engages the block. The block 44 is moved along the channel by rotation of the rod 37.

Figure 5:
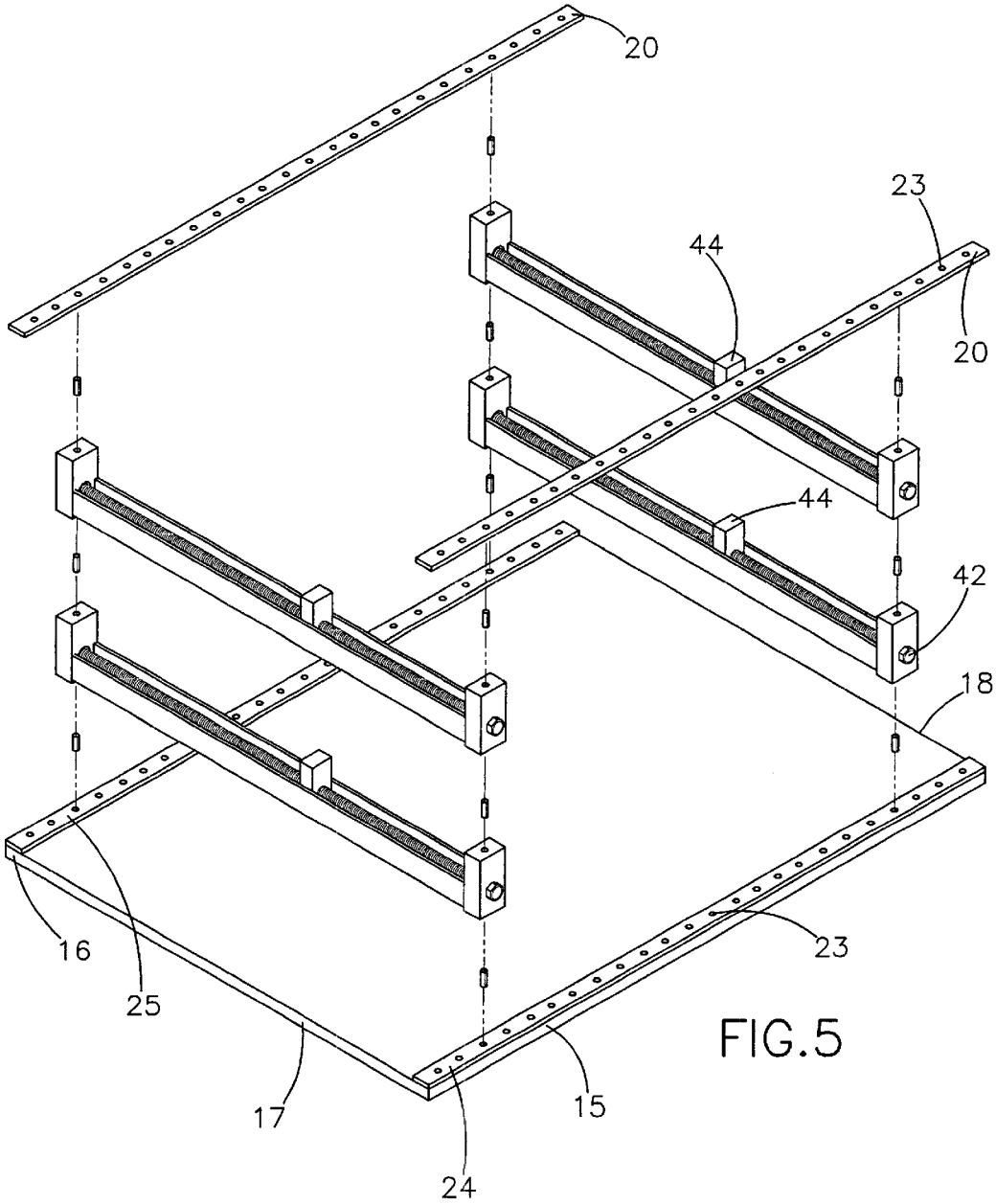
FIG. 5 is a schematic perspective view of the present invention.

A plurality of pins 46 are positionable in the holes 35 in the end walls and in the apertures 23 for selectively coupling the end walls 31, 32 to the mounting and to additional end wall as depicted in FIGS. 1 and 5.

In use, frames 50, and other items, may be positioned on the bars 36 and the blocks 44 moved against the frames 50 for holding them in place while work or gluing is being performed on the frames. The clamps 30 may be stacked on each other for holding a plurality of frames 50 or doors at one time.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clamping system comprising:

a plurality of clamps, each of said clamps comprising;

a first end wall and a second end wall;

a bar extending between and being attached to said end walls, said bar having a channel therein extending between said end walls;

a rod being positioned in said channel and extending between said end walls, said rod being rotatably coupled to said end walls, said rod having a free end extending through said first end wall, said rod being threaded;

a block being positioned in said channel and extending upwardly out of said channel, said rod extending through said block and threadably engaging said block, said block being moved along said channel by rotation of said rod;

a panel having a top surface, a bottom surface, a first edge, a second edge, a third edge, and a fourth edge wherein said first and second edges are located opposite of each other;

a plurality of mountings each being elongated and having a top side and a bottom side, each of said mountings having a plurality of aligned apertures therein extending through said top and bottom sides, the bottom side of a first of said mountings being attached to said top surface of said panel and extending along said first edge, the bottom side of a second of said mountings being attached to said top surface of said panel and extending along said second edge;

each of said end walls having a having a upper surface and a lower surface having a hole extending therein; and a plurality of pins for positioning in said holes in said end walls and in said apertures for selectively coupling said end walls to said mounting and to additional end walls.

2. The clamping system as in claim 1, wherein said bar has a length such each of said end walls may be positioned over one of said first and second mountings when said bar is orientated perpendicular to said first and second mountings.

3. The clamping system as in claim 1, wherein said free end of said rod has a bolt head thereon.

4. A clamping system comprising:

a panel having a top surface, a bottom surface, a first edge, a second edge, a third edge, and a fourth edge wherein said first and second edges are located opposite of each other, said panel having a generally rectangular shape;

a plurality of mountings each being elongated and having a top side and a bottom side, each of said mountings having a plurality of aligned apertures therein extending through said top and bottom sides, the bottom side of a first of said mountings being attached to said top surface of said panel and extending along said first edge, the bottom side of a second of said mountings being attached to said top surface of said panel and extending along said second edge;

a plurality of clamps, each of said clamps comprising;

a first end wall and a second end wall, each of said end walls having a upper surface and a lower surface having a hole extending therein;

a bar extending between and being attached to said end walls, said bar having a length such each of said end walls may be positioned over one of said first and second mountings when said bar is orientated perpendicular to said first and second mountings, said bar having a channel therein extending between said end walls;

a rod being positioned in said channel and extending between said end walls, said rod being rotatably coupled to said end walls, said rod having a free end extending through said first end wall and having a bolt head thereon, said rod being threaded;

a block being positioned in said channel and extending upwardly out of said channel, said rod extending through said block and threadably engaging said block, said block being moved along said channel by rotation of said rod; and a plurality of pins for positioning in said holes in said end walls and in said apertures for selectively coupling said end walls to said mounting and to additional end walls.

5. A clamping system comprising:

at least one clamp comprising;

a first end wall and a second end wall;

a bar extending between and being attached to said end walls, said bar having a channel therein extending between said end walls;

a rod being positioned in said channel and extending between said end walls, said rod being rotatably coupled to said end walls, said rod having a free end extending through said first end wall, said rod being threaded;

a block being positioned in said channel and extending upwardly out of said channel, said rod extending through said block and threadably engaging said block, said block being moved along said channel by rotation of said rod;

a panel having a top surface, a bottom surface;

a plurality of mountings each being elongated and having a top side and a bottom side, each of said mountings having a plurality of aligned apertures therein extending into said top side, the bottom side of said mountings being attached to said top surface of said panel; and securing means for releasably securing said end walls to said mountings.

6. The clamping system as claim 5, wherein said at least one clamp comprises a plurality of said clamps.

7. The camping system as claim 5, wherein said panel has a first edge, a second edge, a third edge, and a fourth edge wherein said first and second edges are located opposite of each other, a first of said mountings extending along said first edge, a second of said mountings being extending along said second edge.

8. The clamping system as claim 5, wherein each of said end walls has a upper surface and a lower surface having a hole extending therein, said securing means including a plurality of pins for positioning in said holes in said end walls and in said apertures for selectively coupling said end walls to said mounting and to additional end walls.

* * * * *